United States Patent [19]

Carroll

[11] Patent Number: 4,637,316

[45] Date of Patent: Jan. 20, 1987

[54] RAIL CAR POSITIONING SYSTEM

[76] Inventor: Curtis E. Carroll, 9957 Tracy Rd., Atoka, Tenn. 38004

[21] Appl. No.: 727,124

[22] Filed: Apr. 25, 1985

[51] Int. Cl.[4] ..... B61J 3/04

[52] U.S. Cl. ..... 104/176; 104/178

[58] Field of Search ..... 104/162, 165, 176, 26 R, 104/173 R, 178

[56] References Cited

U.S. PATENT DOCUMENTS

| | | | |
|---|---|---|---|
| 3,028,819 | 4/1962 | Brosnan | 104/176 |
| 3,141,420 | 7/1964 | Garbers | 104/178 X |
| 3,146,728 | 9/1964 | Doorley | 104/162 |
| 3,377,961 | 4/1968 | Hunt | 104/162 |
| 3,408,953 | 11/1968 | Saxonmeyer | 104/178 X |
| 3,508,499 | 4/1970 | Collins | 104/176 |
| 3,530,802 | 9/1970 | Edens | 104/176 |

FOREIGN PATENT DOCUMENTS

| | | | |
|---|---|---|---|
| 1246197 | 8/1967 | Fed. Rep. of Germany | 104/162 |
| 1909203 | 9/1969 | Fed. Rep. of Germany | 104/162 |

*Primary Examiner*—Robert B. Reeves
*Assistant Examiner*—Glenn B. Foster
*Attorney, Agent, or Firm*—B. P. Fishburne, Jr.

[57] ABSTRACT

A simplified and reliable apparatus for positioning rail cars at a loading or unloading station is disclosed. A rail car movement carriage traverses carriage guide rails anchored to cross-ties between the rail car rails. The carriage includes an onboard hydraulic system in which a single power cylinder activates crossed pivotally connected rail car axle engaging arms in a precision mode. The carriage also mounts a transverse support arm on one end of which is carried a limit switch and limit switch actuator which responds to contact with the flanges of rail car wheels during reverse travel of the carriage to count wheels and thereby establish a proper starting point for the forward movement of the carriage and activation of the car axle engaging arms. The other end of the carriage mounted cross arm is attached to a foldable feed tray which receives and stabilizes an electrical cable supplying power to a motor and valve of the hydraulic system on the carriage. A programmable controller records the rail car wheel count. When the preselected count has been recorded, reverse movement of the carriage will stop and after a brief time delay interval, the car axle engaging arms will rise into engagement with the adjacent car axle. At this point, an operator assumes control of the carriage forward movement or can select automatic operation.

4 Claims, 5 Drawing Figures

RAIL CAR POSITIONING SYSTEM

BACKGROUND OF THE INVENTION

A definite need exists for a simplified and reliable rail car movement and positioning apparatus which is not prohibitively expensive to manufacture and install. While car positioning systems are known in the prior art, they have tended to be unduly complex and very expensive, which factors discourage their use commercially.

Therefore, an object of this invention is to provide a very simple and relatively inexpensive rail car positioning apparatus which is highly reliable, is easy to install, and which moves and positions cars with precision at a car loading or unloading station or the like.

A further and more specific object of the invention is to provide a rail car movement and positioning apparatus which includes a simplified guided carriage having an onboard hydraulic system for operating rail car axle engaging arms in an improved mode. The hydraulic system includes a single power cylinder to control the operation of four pivoted crossing car axle engaging arms, two of which traverses an arc and the other two of which moves in a vertical path to and from the car axle.

Still another object of the invention is to provide in a rail car positioning apparatus an improved and simplified arrangement for counting rail car wheels during reverse movement of the carriage to establish the proper location of the carriage in preparation for its forward movement and the activation of its car axle engaging arms.

A further important object of the invention is to provide a rail car positioning apparatus which includes an improved and simplified cable propulsion system for the rail mounted carriage of the apparatus.

Other features and advantages of the invention will become apparent to those skilled in the art during the course of the following description.

DETAILED DESCRIPTION

Figure 1:
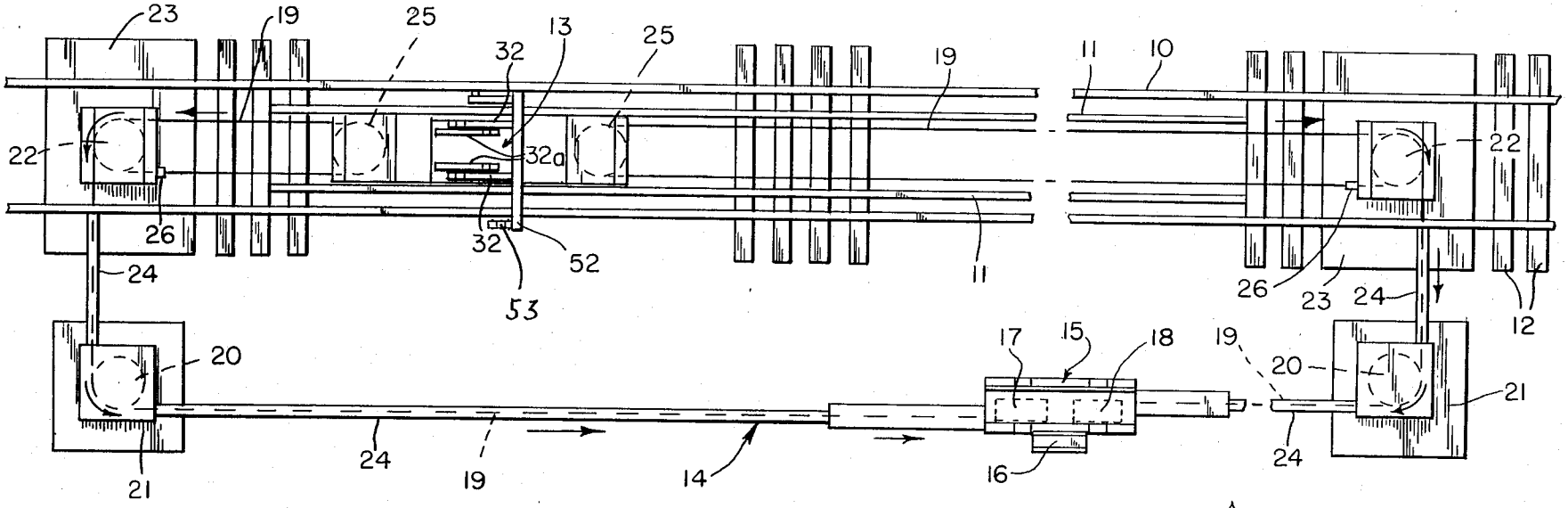
FIG. 1 is a partly schematic plan view of a rail car movement and positioning apparatus according to the present invention and showing a carriage of the apparatus in a rearward position.

Referring to the drawings in detail, wherein like numerals designate like parts, rail car tracks 10 are placed to define a loading and/or unloading station for cars, such as coal cars. Such cars, not shown, are moved into the near vicinity or spotting zone by a switching engine, the car brakes are set and the switching engine uncoupled from the rail cars.

Figure 2:
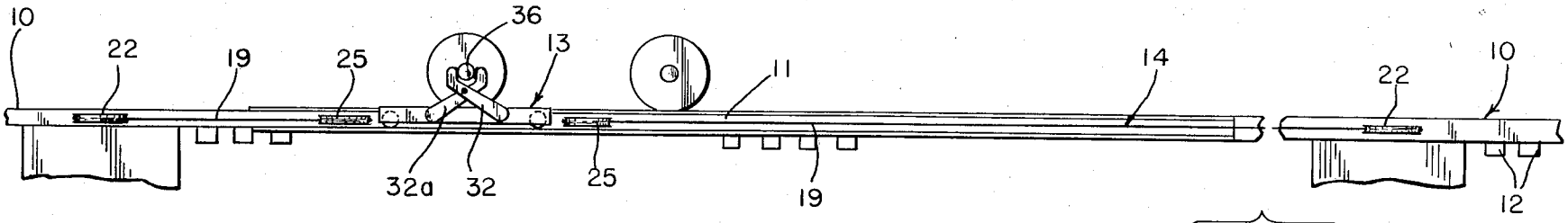
FIG. 2 is a side elevation of the apparatus, partly in cross section.
Figure 4:
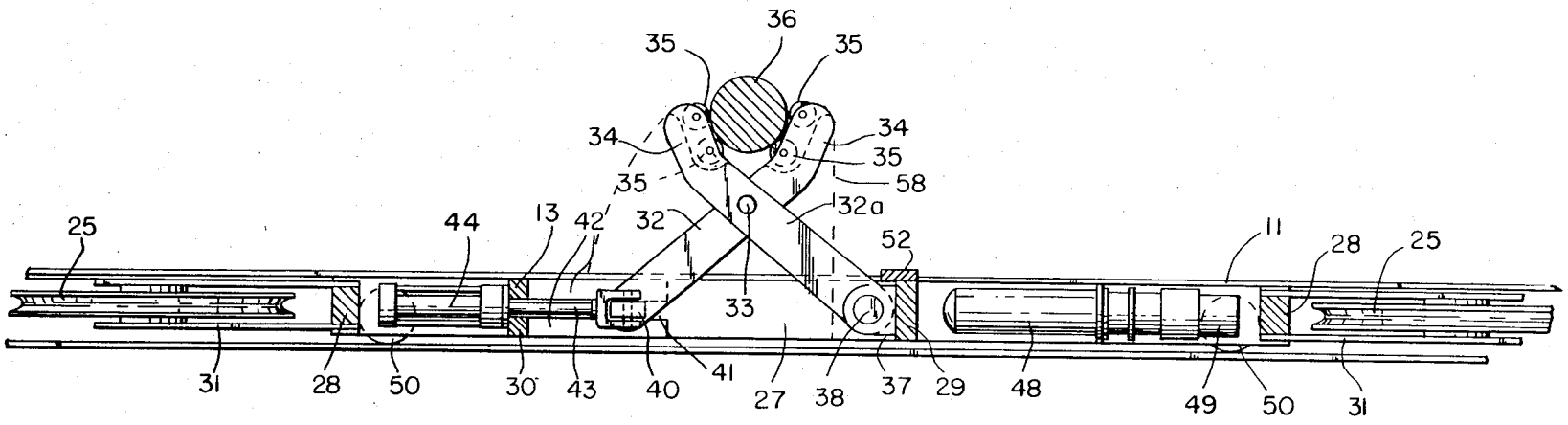
FIG. 4 is a side elevation of the carriage shown in FIG. 3, partly in longitudinal vertical cross section.
Figure 5:
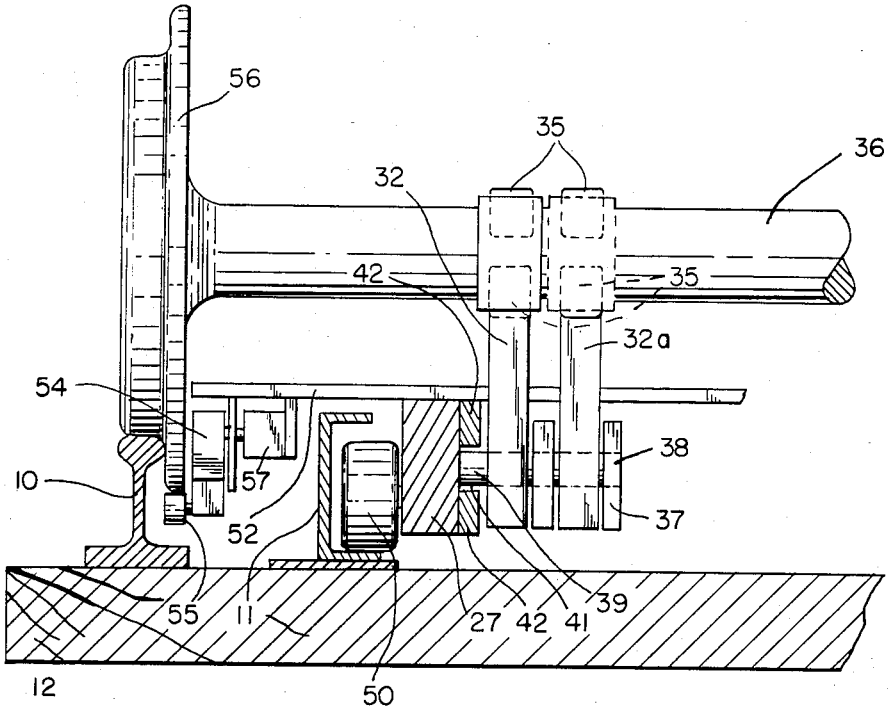
FIG. 5 is a transverse vertical section taken substantially on line 5—5 of FIG. 3, partly broken away.

The apparatus, according to the present invention, shown somewhat schematically in FIGS. 1 and 2, comprises a pair of opposing channel carriage guide rails 11 which are attached to existing crossties 12, as shown in FIG. 5. The rails 11 mount and guide the carriage 13 shown in detail in FIGS. 3–5 and forming a very important feature of the invention. The carriage 13 is propelled forwardly and rearwardly on the rails 11 by a cable propulsion system 14 shown in FIGS. 1 and 2.

The cable propulsion system 14 comprises a dual drum winch assembly 15 having a hydraulic motor 16 for the two winch drums 17 and 18 of the assembly 15. The cables 19 wound on the drums 17 and 18 pass around bending sheaves 20 near the ends of the apparatus and spaced equidistantly from one side thereof. The sheaves 20 are held on fixed foundations 21, FIG. 1. Similar cable bending sheaves 22 installed on foundations 23 are disposed between the rails 10, as shown. Guards 24 protect the cables 19 between the winch assembly 15 and sheaves 20, and between the latter and the sheaves 22.

A pair of sheaves 25 on each end of the carriage 13 receive the cables 19, as shown, and corresponding ends of the cables 19 are attached at 26 to the supports of bending sheaves 22. By means of the described cable propulsion arrangement, the carriage 13 is propelled in either direction along the rails 11, as will be further described. The rotation axes of all of the cable sheaves are vertical and the sheaves, as best shown in FIG. 4, occupy little space in the vertical direction, thereby imparting a very low profile to the propulsion system.

The carriage 13 comprises a low profile rigid rectangular frame having opposite side longitudinal members 27, transverse end members 28 and cross braces 29 and 30. Brackets 31 on the ends of the carriage 13 support the two sheaves 25, as shown in the drawings.

Side-by-side pairs of rail car axle engaging arms 32 and **32*a* are pivotally interconnected between their ends at 33 for simultaneous movement. These arms have upwardly angled portions 34 at their tops, each carrying pairs of steel rollers 35 adapted to engage opposite sides of a rail car axle 36 at proper times, as will be further described. The lower ends of arms 32*a* are pivotally secured to brackets 37 fixed to one side of the cross brace 29 so that the arms 32*a* may swing vertically upwardly and downwardly on their pivot elements 38**.

The lower ends of arms 32 are pivotally connected with guide pins 39 of a slide 40. The guide pins 39 at their outer ends move in horizontal longitudinal guide slots 41 formed by pairs of vertically spaced horizontal guide bars 42 fixed to the inner longitudinal faces of the carriage frame members 27.

Figure 3:
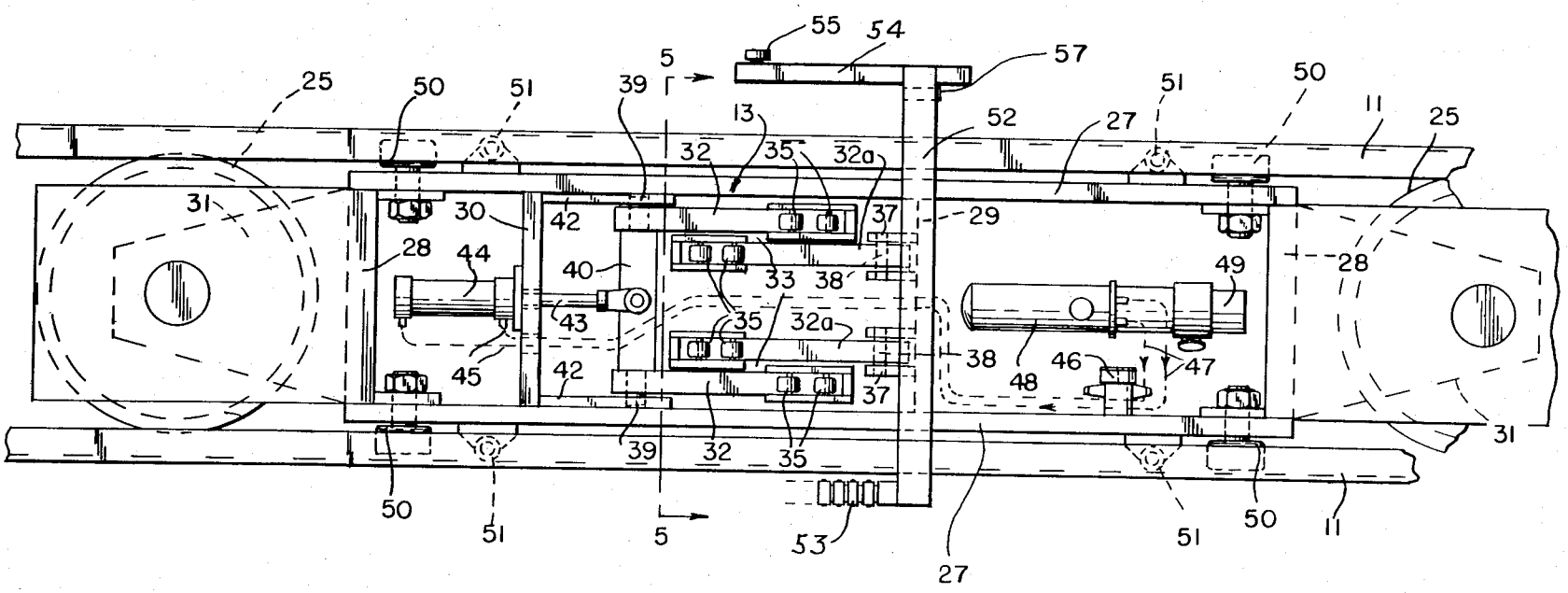
FIG. 3 is a plan view of the apparatus carriage and associated elements.

Attached to the slide 40 at its center is the piston rod 43 of a horizontal longitudinal double-acting hydraulic cylinder 44 attached to the cross brace 30. The cylinder 44 receives and discharges fluid through a pair of fluid lines 45 connected with an electrically operated flow control valve 46. This valve in turn is connected by fluid lines 47 with a suitable hydraulic pump 48 driven by an electric motor 49, as shown in FIG. 3. The entire hydraulic system for operating the arms 32 and **32*a* is on the carriage 13**, is very simplified and is self-contained.

The carriage 13 is equipped near its ends with main support and guide wheels 50 which follow the channel rails 11. Lateral guide wheels 51 for the carriage 13 are also provided and attached to the frame members 27, as shown in FIG. 3.

Another important aspect of the invention comprises the provision on the carriage 13 near its longitudinal center of a cross arm 52 which is suitably anchored to the top faces of the members 27 and 29 of the carriage frame. At one of its ends, outboard of the adjacent channel rail 11, FIG. 3, the cross arm 52 is connected with a conventional flexible channel track or tray 53, such as a Gleason Reel Corp. PLASTI-TRAK or equivalent device. This flexible track receives and supports an electrical power cable, not shown, which delivers power to the pump motor 49 and valve 46. The flexible track 53 has the ability to fold over itself longitudinally as the carriage 13 moves in either direction on the rails 11. It prevents kinking or tangling as well as misalignment of the electrical cable.

At its opposite end, the arm 52 carries a pivoted vertically swingable longitudinal bracket or member 54 which carries at its rear end and outer side an actuating roller 55 which is tripped downwardly by contact with the flange 56, FIG. 5, of each rail car wheel during rearward movement of the carriage 13, as will be further described. Such downward displacement of the roller 55 and pivoted bracket 54 operates an adjacent limit switch 57 carried by the arm 52 and being connected with the movable bracket 54. Each time the switch 57 is closed, an electrical signal is sent to a remote programmable controller, not shown, which records a rail car wheel count. When a preselected count has been reached, rearward travel of the carriage 13 under influence of the cable propulsion system shown in FIG. 1 will be stopped. After a short predetermined time delay interval, the car axle engaging arms 32 and 32*a* will rise and position themselves in engagement with the adjacent car axle 36, as shown in FIG. 4. At this time, an operator of the system can assume control of the carriage 13 or can select automatic operation. The programmable controller for the apparatus is conventional state-of-the-art equipment and need not be shown or described for a full understanding of the present invention.

While FIGS. 1 and 2 show the carriage 13 in the rearmost position, the operation of the apparatus actually begins with the carriage positioned at the forward end of its travel zone. The reverse end of the carriage travel zone is that end which rail cars are brought into the travel zone of the apparatus by a switching engine or the like. When so positioned by the switching engine, the rail car brakes are set and the switching engine is uncoupled from the car.

Depending upon individual case requirements, the conventional programmable controller is preset so that the wheel flange contact roller 55 and associated switch 57 will deliver wheel and wheel axle counting signals to the controller which can record the count. The preset count determines which particular wheel axle 36 will be engaged by the arms 32 and 32*a* and their rollers 35, and therefore which rail car will be moved forwardly by the apparatus and positioned properly at the loading or unloading station. The system is very flexible in terms of its ability to quickly count the rail car wheels and terminate the rearward travel of the carriage 13 at a correct location.

Another feature of importance in the invention is the manner in which the arms 32 and 32*a* rise into precision engagement with a selected car axle 36 under control of the single power cylinder 44. The arms 32*a* swing upwardly in an arcuate path around the axes of their pivot elements 38 and their rollers 35 engage the rear of the car axle 36. Simultaneously, due to the pivotal connection 33 and the arrangement of the pins 39 in the guide slots 41, the arms 32 are elevated on a linear vertical path as denoted by the broken line 58 in FIG. 4 until the rollers 35 engage the front side of car axle 36. This particular arrangement contributes materially to the proper precision engagement of the rail car propelling arms 32 and 32*a* with the car axles, closely following the automatic positioning of the carriage 33 on its rearward travel by the described wheel flange counting arrangement.

When the rail car is moved forwardly by the apparatus to the required location, the arms 32 and 32*a* will be moved to their lowered positions by the cylinder 44 where the arms are substantially flush with the frame of the carriage. Limit switches, not shown, are provided to sense the positions of the arms 32 and 32*a* for signalling the operator as to whether the arms are up or down and therefore when it is safe to move the carriage 13.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A rail car movement and positioning apparatus comprising a pair of spaced parallel opposing horizontal channel rails adapted to be mounted on existing crossties between existing rail car tracks, a carriage comprising an elongated low profile horizontal rectangular frame having side longitudinal frame bars and opposite end frame bars and a pair of transverse cross braces all disposed in a common horizontal plane, horizontal transverse axis guide wheels and vertical axis guide wheels on said frame near opposite ends thereof and being guidingly engaged with said channel rails, a forward and reverse cable propulsion system for said carriage including a pair of vertical axis sheaves on said end frame bars of the carriage, a single horizontal axis power cylinder having a cylinder body fixed to one of said cross braces and having a piston rod extending longitudinally of the carriage at the transverse center of the carriage, said power cylinder being disposed in a common horizontal plane with the carriage, means forming horizontal longitudinal guideways on said carriage along the interiors of the carriage side longitudinal frame bars near said one cross brace, a transverse horizontal slide bar having ends guidingly engaged with said guideways and being connected at its transverse center with said piston rod, a first pair of rail car axle-engaging arms pivotally attached to the other cross brace of said pair between said side longitudinal frame bars on horizontal transverse axis pivots and being swingable in a vertical plane, and being disposed on opposite sides of the piston rod, a second pair of rail car axle-engaging arms pivotally attached to said slide bar on opposite sides of said piston rod and being pivotally connected with the first pair of rail car axle-engaging arms and being movable upwardly and downwardly therewith in vertical planes relative to said carriage under influence of said power cylinder, a fluid pressurizing system for said power cylinder on said carriage and moving with the carriage and being self-contained and being operatively connected with the power cylinder, a horizontal cross arm fixed on said carriage adjacent to said other cross brace and extending laterally outwardly of said channel rails, an electrical limit switch on said cross arm near one end thereof and laterally outwardly of one channel rail, a pivoted member on said one end portion of the cross member and being operatively connected with said limit switch and extending longitudinally of said carriage and being disposed near and inwardly of one existing rail car track and being adapted to swing in a vertical plane, a rail car wheel flange contact element on said pivoted member and adapted in response to contact with a rail car wheel flange to move the pivoted member and operate said limit switch during movement of said carriage in one direction, and a flexible track for the support and stabilization of an electrical power cable attached to the other end portion of said cross arm.

2. A rail car movement and positioning apparatus comprising a pair of spaced parallel rails adapted to be mounted on crossties between existing rail car tracks, a low profile carriage guidingly mounted on said rails and lying substantially in a common horizontal plane with said rails, a cable propulsion system for moving said carriage in opposite directions on said rails and having connections with opposite ends of said carriage, a single horizontal axis power cylinder on said carriage and having a piston rod extending longitudinally of said rails substantially at the transverse center of the carriage, the carriage having opposite side horizontal guideways, a transverse horizontal slide having end portions engaged with said guideways and being horizontally movable therealong relative to the carriage and being connected with said piston rod, two cooperating pairs of rail car axle-engaging arms one of said pair of rail engaging arms being pivotally attached to said carriage and the other of said pair of rail engaging arms being pivotally attached at their lower ends to said slide, the arms of each pair crossing and being pivotally connected intermediate their ends, whereby the arms are raised and lowered in unison by the operation of said power cylinder, a self-contained fluid pressurizing system for said power cylinder on said carriage near one end of the carriage, said power cylinder being located near the other end of the carriage and said rail car axle-engaging arms being located near the longitudinal center of the carriage and between the power cylinder and said pressurizing system, a horizontal cross arm on said carriage near said rail car axle-engaging arms and extending laterally outwardly from one side of said carriage and one of said rails, a pivoted member on said cross arm and being swingable thereon in a vertical plane and being located laterally outwardly of said one rail and near and inwardly of one existing rail car track, a rail car wheel flange contact element on said pivoted member, and an electrical limit switch on said cross arm and being operatively connected with said pivoted member.

3. A rail car movement and positioning apparatus as defined in claim 2, and said power cylinder comprising a double acting power cylinder.

4. A rail car movement and positioning apparatus as defined in claim 2, and said cable propulsion system including a dual drum winch near and spaced from one side of the apparatus, cables on the drums of said winch and being engaged with said connections, said connections comprising vertical axis sheaves carried by opposite ends of said carriage, fixed vertical axis sheaves guidingly engaged with the cables near and spaced from one side of the apparatus, and additional fixed vertical axis guide sheaves for the cables engaged therewith in substantial alignment with the opposite ends of the carriage, all of the vertical axis sheaves lying substantially in a common horizontal plane between the tops and bottoms of said rails.

* * * * *